US010008832B2

(12) United States Patent
Quest et al.

(10) Patent No.: US 10,008,832 B2
(45) Date of Patent: Jun. 26, 2018

(54) SPARK PLUG ELECTRODE, METHOD FOR ITS PRODUCTION, AND SPARK PLUG

(71) Applicant: Robert Bosch GmbH, Stuttgart (DE)

(72) Inventors: Dennis Quest, Bamberg (DE); Detlef Hartmann, Bamberg (DE); Dominic Lang, Lauter-Deusdorf (DE); Guido Hannich, Memmelsdorf (DE); Stefan Nufer, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 15/527,507

(22) PCT Filed: Oct. 1, 2015

(86) PCT No.: PCT/EP2015/072719
§ 371 (c)(1),
(2) Date: May 17, 2017

(87) PCT Pub. No.: WO2016/078816
PCT Pub. Date: May 26, 2016

(65) Prior Publication Data

US 2017/0331260 A1 Nov. 16, 2017

(30) Foreign Application Priority Data

Nov. 21, 2014 (DE) ..... 10 2014 223 792

(51) Int. Cl.
*H01T 13/39* (2006.01)
*H01T 21/02* (2006.01)

(52) U.S. Cl.
CPC ..... *H01T 13/39* (2013.01); *H01T 21/02* (2013.01)

(58) Field of Classification Search
USPC ..... 123/169 EL
See application file for complete search history.

(56) References Cited

U.S. PATENT DOCUMENTS 6,304,022 B1 * 10/2001 Matsutani ..... H01T 13/39 313/118
2002/0017846 A1 * 2/2002 Hori ..... H01T 13/39 313/141
2010/0253203 A1 * 10/2010 Suzuki ..... C22C 5/04 313/141
2010/0264796 A1 * 10/2010 Musasa ..... H01T 13/39 313/11.5

(Continued)

FOREIGN PATENT DOCUMENTS

DE 10137523 A1 6/2002
DE 10239075 A1 4/2003

OTHER PUBLICATIONS

International Search Report dated Dec. 7, 2015, of the corresponding International Application PCT/EP2015/072719 filed Oct. 1, 2015.

*Primary Examiner* — Ashok Patel
(74) *Attorney, Agent, or Firm* — Norton Rose Fulbright US LLP; Gerard Messina

(57) ABSTRACT

A spark plug electrode having greater mechanical stability. The spark plug electrode includes a base body and a noble metal pin situated on the base body, the base body and the noble metal pin being connected to each other by a connection zone. The connection zone has at least one first welding seam and one second welding seam.

20 Claims, 4 Drawing Sheets

(56) References Cited

U.S. PATENT DOCUMENTS

2011/0177744 A1* 7/2011 Hartmann ..... H01T 13/32
445/7
2011/0285270 A1* 11/2011 Tanaka ..... H01T 13/39
313/141

* cited by examiner

SPARK PLUG ELECTRODE, METHOD FOR ITS PRODUCTION, AND SPARK PLUG

FIELD

The present invention relates to a spark-plug electrode having greater mechanical robustness, to a permanently high-capacity spark plug and to an easily implementable method for producing the spark plug electrode.

BACKGROUND INFORMATION

Spark plug electrodes having satisfactory corrosion and erosion resistance are conventionally produced by welding a noble metal pin, for the most part made of platinum or iridium base alloys, onto an electrode base body. The electrode base body is developed from a base metal. Due to the different coefficients of thermal expansion of the noble metal and the base metal, mechanical stresses occur along the welding seam, which reduce the mechanical stability and thus the durability and loading capacity of the spark plug electrode.

SUMMARY

In contrast, an example spark plug electrode in accordance with the present invention has a high mechanical loading capacity and an excellent maximum fatigue strength. According to the present invention, this may be achieved by interconnecting an electrode base body and a noble metal pin by way of a connection zone that has at least one first welding seam and one second welding seam. Preferably, the connection zone includes precisely one first welding seam and one second welding seam; moreover, the first welding seam and the second welding seam preferably extend completely through the spark plug electrode. Thus, the spark plug electrode according to the present invention provides the additional advantage that mechanical stresses that occur in the connection zone during the engine operation are distributed to a plurality of regions, i.e., the boundary surfaces or joining surfaces of the noble metal pin/connection zone and the connection zone/base body, as well as the boundary surface or joining surface between the first welding seam and the second welding seam. The stability of the spark plug electrode, and in particular its mechanical stability, is therefore increased at a very high performance.

Preferred further developments of the present invention are described herein.

According to an advantageous further refinement, the first welding seam is situated between the noble metal pin and the base body, and the second welding seam is situated either between the first welding seam and the noble metal pin or between the first welding seam and the base body. In the former case, a noble metal concentration in the first welding seam is lower than a noble metal concentration in the second welding seam. In the second case, a noble metal concentration in the first welding seam is greater than a noble metal concentration in the second welding seam. In both cases the noble metal concentration has a descending gradient from the noble metal pin to the base body. An abrupt decrease in the noble metal concentration from the noble metal pin to the base body is prevented by the development of the connection zone that includes at least two welding seams having different noble metal contents. The correspondingly developed different noble metal contents result in an additional advantage: Since the coefficient of thermal expansion of a material is formed in the first approximation by a linear superpositioning of the coefficients of thermal expansion of all elements and compounds present in the region to be examined, the coefficient of thermal expansion also changes gradually from the noble metal pin across the connection zone to the base body, i.e. essentially with a uniform rather than an abrupt progression. This further reduces mechanical stresses in the spark plasma in the connection zone and particularly at the boundary surfaces or joining surfaces of the noble metal pin/connection zone and the connection zone/base body. The stability of the spark plug electrode is markedly increased at a very high performance.

In addition, abruptly changing coefficients of thermal expansion along the spark plug electrode may advantageously be avoided in that a noble metal component in the first welding seam and the second welding seam amounts to at least 40 mass-%. Especially preferably, the noble metal component of the first welding seam and the second welding seam amounts to at least 50 mass-%, the components being related to the total weight of the first welding seam and the second welding seam.

In light of a steadily changing coefficient of thermal expansion, i.e., one that changes continually in idealized terms, and therefore in light of an especially satisfactory mechanical robustness of the spark plug electrode, it is particularly advantageous if the noble metal concentration in the connection zone changes by maximally 40 mass-%, and preferably by maximally 25 mass-%, per interval of 100 μm length of the connection zone in the longitudinal direction X-X of the spark plug electrode.

Moreover, for the stable generation of a spark plasma, it is advantageously provided that a length L1 of the noble metal pin in the longitudinal direction X-X of the spark plug electrode amounts to maximally 900 μm. Thus, an excellent central development of the ignition spark is generated on the noble metal pin. In view of reducing the cost of the spark plug electrode, it is furthermore advantageous if length L1 of noble metal pin amounts to 80 μm to 200 μm.

In addition, the stability of the spark plug electrode may advantageously be improved by selecting a length L2 of the connection zone of 50 μm to 700 μm, and in particular, of 100 μm to 600 μm, in the longitudinal direction X-X of the spark plug electrode.

A coefficient of thermal expansion that steadily changes in the connection zone, and thus a particularly high mechanical durability of the spark plug electrode, is advantageously obtained if a length L3 of the first welding seam and a length L4 of the second welding seam are approximately equal in size in the longitudinal direction X-X of the spark plug electrode.

To improve the corrosion and erosion resistance of the spark plug electrode given an excellent generation of an ignition spark plasma, the noble metal is selected from iridium (Ir), rhodium (Rh), platinum (Pt), palladium (Pd), rhenium (Re) and alloys of these elements. Nickel may be alloyed to the noble metal or to the alloy of the aforementioned noble metals in an effort to reduce costs.

A balanced characteristics spectrum with regard to the mechanical and physical properties of the spark plug electrode at an optimized cost structure is advantageously obtained if the base body is developed from a nickel-containing alloy, a nickel component in the alloy in particular amounting to at least 50 mass-% in relation to the total weight of the alloy.

The present invention also provides a spark plug that includes a spark plug electrode as described in the previous text. The spark plug electrode may be developed as a center electrode or as a ground electrode. In addition, it is also possible that both the center electrode and the ground electrode, possibly also a plurality of provided ground electrodes, are formed by the spark plug electrode according to the present invention. The spark plug is distinguished by a high mechanical durability while providing an excellent spark generation. Exchange intervals of up to approximately 100,000 km are able to be achieved.

In addition, a method for producing a spark plug electrode having a base body and a noble metal pin is provided. Here, it should be noted that this method is particularly suitable for the production of the afore-described spark plug electrode. The method is simple, implementable without great technical complexity with the aid of standard processes, and it allows the production of a high-performance, mechanically durable and stable spark plug electrode at low cost. While a conventional spark plug electrode is produced by simply welding a noble metal pin onto an electrode base body, the present invention provides for the development of at least two welding seams. A first welding seam is created by carrying out a first welding operation, by which the noble metal pin and the base body of the spark plug electrode are joined. A second welding operation, which produces a second welding seam, is subsequently carried out. The second welding operation may be performed either in a region between the first welding seam and the noble metal pin or in a region between the first welding seam and the base body. If the second welding operation is implemented between the first welding seam and the noble metal pin, as described in the first case, then a noble metal concentration in the first welding seam is lower than in the second welding seam. If the second welding operation is performed between the first welding seam and the base body, then a noble metal concentration in the first welding seam is greater than in the second welding seam. The first welding seam and the second welding seam form a connection zone between the noble metal pin and the base body, which firmly connects the noble metal pin to the base body. With the aid of the first welding operation, the respective materials at a boundary surface of the noble metal pin and the base body are melted and then combine to form a mixed material in which a noble metal component of the noble metal pin and a component of the material of the base body, i.e., particularly of a base metal of the base body, are approximately equal. The noble metal concentration thus decreases abruptly from the noble metal pin across the connection zone to the base body, from 100 mass-% to approximately 50 mass-% to 0 mass-%. As a consequence, the coefficient of thermal expansion also takes on an abrupt characteristic since it is roughly linearly made up of the coefficients of thermal expansion of the elements and compounds forming the region under review, as previously described. The steepness of the gradient run through by the coefficient of thermal expansion is reduced by the development of the second welding seam and possibly additional welding seams. In other words, the gradual change in the coefficient of thermal expansion is attenuated. A gradual and thus approximately continuous change comes about in the coefficient of thermal expansion. The reason for this is that the material of the first welding seam is re-melted by the second welding operation and is alloyed either with further noble metal from the noble metal pin by carrying out the welding operation between the first welding seam and the noble metal pin, or with further material from the base body by carrying out the welding operation between the first welding seam and the base body. Thus, a further graduated mixture concentration of the melted initial elements develops in the second welding seam, the mixture concentration lying between that of the pure noble metal and the first welding seam or between that of the base body material and the first welding seam. It is possible to use the same method setup as for the execution of the first welding operation, with the difference that the orientation of the laser beam is slightly modified locally. The technical outlay is thus identical. The method may therefore be carried out in a cost-effective manner at a slightly higher expenditure in time.

The advantages, advantageous effects and further refinements described for the spark plug electrode according to the present invention also apply to the spark plug according to the present invention and to the method for producing a spark plug electrode according to the present invention.

Due to the advantageous refinement according to which the welding is carried out with the aid of laser welding, an especially even welding seam is able to be produced locally in the desired region. The use of a continuous wave laser (CW laser) especially contributes to the development of a homogeneous welding seam.

According to another advantageous further refinement of the present method, the second welding operation is carried out in a region that lies at a distance from a connection surface or boundary surface of the first welding seam and the noble metal pin, the distance amounting to 5 μm to 50 μm, and in particular 10 μm to 30 μm, in the direction of the noble metal pin. This further enhances a second welding seam that features a large layer thickness and good stability, which is beneficial for the overall mechanical stability of the spark plug electrode.

A particularly uniform change in the concentration gradient of the elements, and thus also in the coefficient of thermal expansion, is advantageously achieved in that a laser beam fully penetrates the materials to be welded during the first welding operation and the second welding operation.

This effect may be further enhanced by rotating the spark plug electrode during the welding operation. The laser beam then acts on an identically dimensioned section of the materials to be welded per time interval.

BRIEF DESCRIPTION OF THE DRAWINGS

In the following text, exemplary embodiments of the present invention will be described in detail with reference to the figures. Identical or functionally equivalent components have been denoted by the same reference numerals.

DETAILED DESCRIPTION OF EXAMPLE EMBODIMENTS

Below, a spark plug 1 according to a preferred exemplary embodiment of the present invention as well as a spark plug electrode 10 according to a preferred exemplary embodiment of the present invention will be described in detail with reference to FIGS. 1 through 4.

Figure 1:
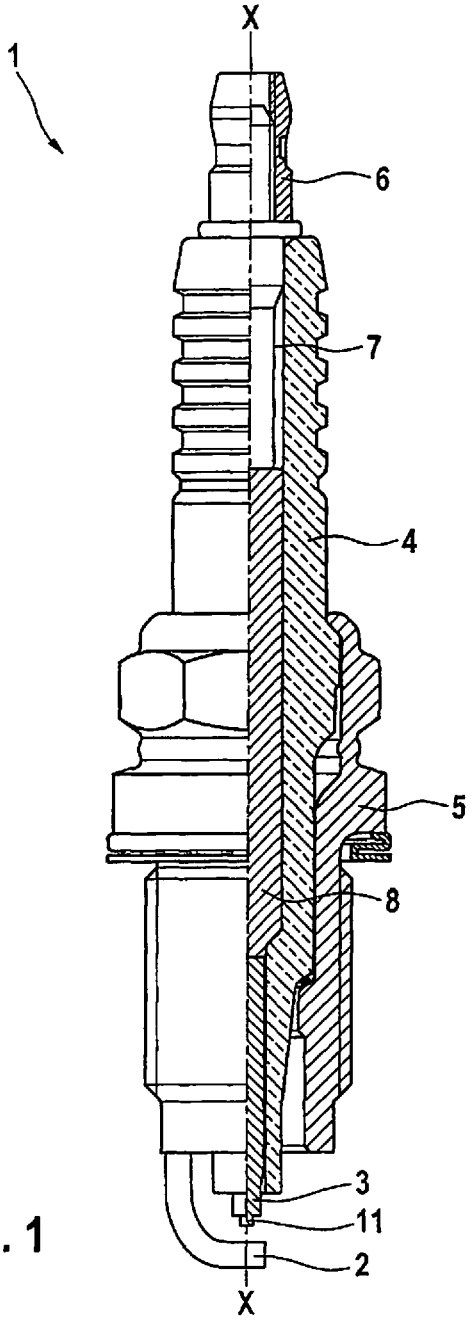
FIG. 1 shows a part-sectional view of a spark plug according to a specific embodiment of the present invention.

As shown in FIG. 1, spark plug 1 includes a ground electrode 2 and a center electrode 3. An insulator 4 is provided in such a way that center electrode 3 slightly projects from insulator 4 in the known manner. Center electrode 3 has a noble metal pin 11. Insulator 4 itself is partially surrounded by a housing 5. Reference numeral 6 denotes an electric terminal nut. An electrically conductive connection is provided from electric terminal nut 6 to center electrode 3 via a terminal stud 7 and an electrically conductive connection element 8.

Figure 2:
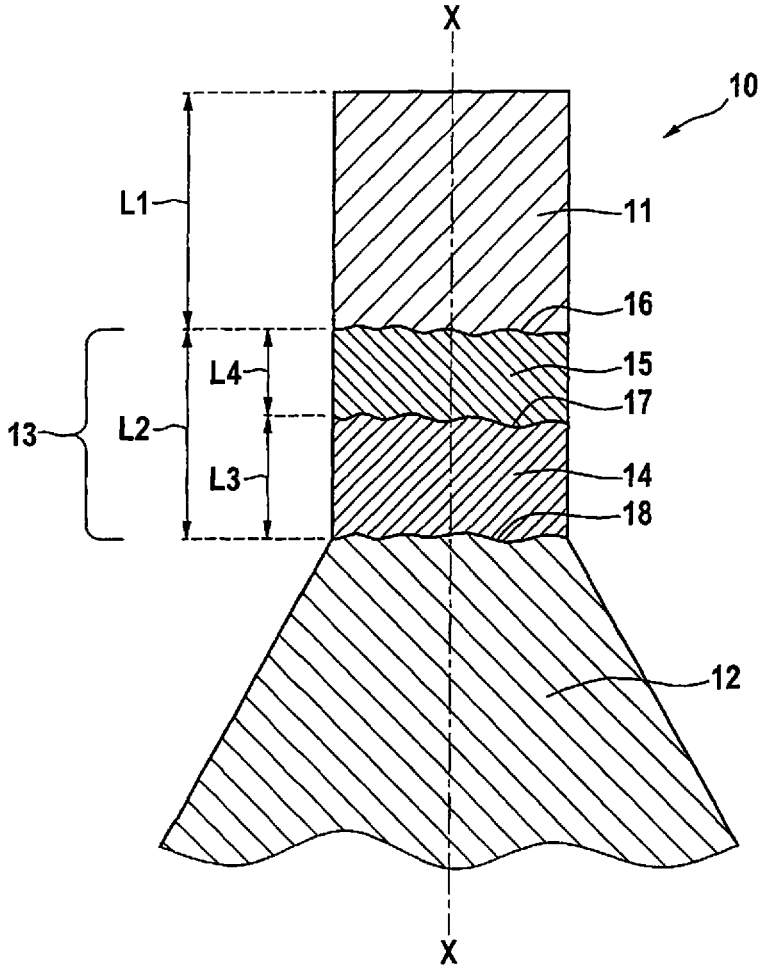
FIG. 2 shows a sectional view of a spark plug electrode according to a specific embodiment of the present invention.

FIG. 2 shows in detail a design of a spark plug electrode 10 according to a preferred specific embodiment of the present invention. Spark plug electrode 10 may be developed as a ground electrode or as a center electrode. Spark plug electrode 10 includes a base body 12, which is connected to an electrically conductive connection element in case of a development as a center electrode. The base of base body 12 is developed thicker than the remaining area of base body 12, so that is it able to be fixed in place on spark plug 1 in a stable manner.

Base body 12 is advantageously made from a nickel-containing alloy, a nickel component of the alloy in particular amounting to at least 50 mass-% in relation to the total weight of the alloy.

In addition, the spark plug electrode has a noble metal pin 11, which is used for generating the spark plasma. Noble metal pin 11 may be made from a pure noble metal, in particular from Ir, Rh, Pt, Pd or Re, or from alloys of these elements. Moreover, it is also possible to develop noble metal pin 11 from alloys of the aforementioned elements and nickel as a further component. Noble metal pin 11 has a length L1 of preferably maximally 900 μm, and in particular of 80 μm to 200 μm, in the longitudinal direction X-X of spark plug electrode 10. This is particularly advantageous for generating ignition sparks.

A connection zone 13 connects noble metal pin 11 and base body 12 to each other. In this exemplary embodiment, connection zone 13 is made up of two welding seams, i.e. a first welding seam 14 which is facing base body 12, and a second welding seam 15 which is facing noble metal pin 11. Noble metal pin 11 is situated on base body 12 in a stable manner with the aid of connection zone 13.

In the longitudinal direction X-X of spark plug electrode 10, connection zone 13 has a length L2 of 10 μm to 700 μm, and in particular of 100 μm to 600 μm. This produces a mechanically stable connection between noble metal pin 11 and base body 12.

If one examines connection zone 13, then a noble metal concentration in first welding seam 14 is lower than a noble metal concentration in second welding seam 15. However, when considered overall, a noble metal concentration both in first welding seam 14 and in second welding seam 15 is less than in noble metal pin 11 but greater than in base body 12. As a result, there are four regions having different concentrations of noble metal in spark plug electrode 10. The noble metal concentration essentially decreases steadily, i.e., without abrupt changes, from noble metal pin 11, where it lies at 100% or less depending on the initial material used, across the second welding seam 15 and first welding seam 14, in the direction of base body 12, where the noble metal concentration amounts to 0% (or is low depending on the material used for base body 12).

It is advantageous for a steadily decreasing noble metal concentration if a length L3 of first welding seam 14 and a length L4 of second welding seam 15 are approximately of equal size in the longitudinal direction X-X of spark plug electrode 10.

It follows from the concentration characteristic of the noble metal concentration from noble metal pin 11 to base body 12 that a coefficient of thermal expansion from noble metal pin 11 to base body 12 also increases in an essentially continuous manner, without increasing or decreasing very abruptly. If high temperatures are acting on spark plug electrode 10 during the engine operation, then these temperatures are able to be better tolerated. Reduced mechanical stresses arise at boundary surfaces 16-18, i.e., boundary surface 16 of noble metal pin 11/second welding seam 15, boundary surface 17 of second welding seam 15/first welding seam 14, and boundary surface 18 of first welding seam 14/base body 12. The service life of spark plug electrode 10 is thus increased significantly.

Figure 3:
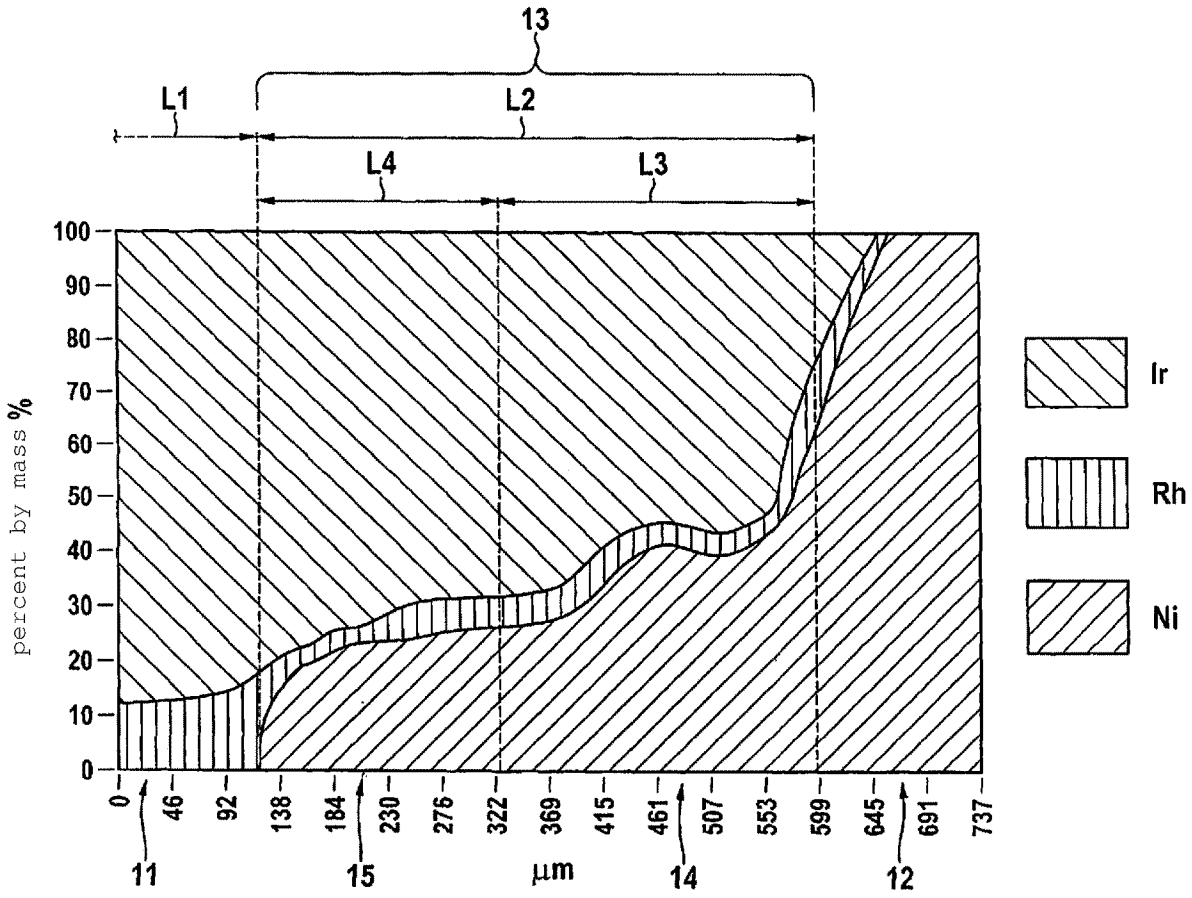
FIG. 3 shows an element distribution in a cutaway of the spark plug electrode from FIG. 2.

FIG. 3 shows an element distribution in a cutaway of spark plug electrode 10 from FIG. 2. The regions of different chemical elements are shown by different shadings. The perpendicular dashed lines subdivide spark plug electrode 10 into its different regions along longitudinal direction X-X of spark plug 10. The mass distribution of the elements in mass percent (mass-%) versus the length of spark plug electrode 10 has been plotted in μm. The left section represents that of noble metal pin 11. Here, it can be seen that noble metal pin 11 is made up of noble metal to 100 mass-%, i.e. an alloy of Ir and Rh. Adjoining the left section is the section of second welding seam 15. Here, the noble metal component, which is meant to denote a total component of the noble metals Ir and Rh, is less than in noble metal pin 11. The noble metal component has decreased from 100 mass-% to approximately 75 mass-%. The remaining 25 mass-% are taken up by nickel, which was alloyed when developing connection zone 13. The section of second welding seam 15 is followed by the section of first welding seam 14. Here, the noble metal concentration has decreased further. A noble metal component in first welding seam 14 now lies at approximately 60 mass-%. The remaining 40 mass-% is taken up by nickel. The right section shows the element distribution in base body 12. Base body 12 consists of virtually 100 mass-% of nickel (or a nickel-containing alloy). The noble metal concentration continues to decrease from second welding seam 15 to base body 12.

It is easy to see that the noble metal concentration in connection zone 13 changes in the longitudinal direction X-X of spark plug electrode 10 by maximally 40 mass-% and mostly by maximally 25 mass-% per interval of 100 μm length of connection zone 13. Abrupt changes in the element concentration particularly with a change of more than 50 mass-% are not present. By providing additional welding seams, a further softening of the increase in the noble metal concentration may be achieved in regions of a more pronounced change in the noble metal concentration.

It can furthermore be seen that length L3 of first welding seam 1 and length L4 of second welding seam 15 are approximately identical in size in the longitudinal direction X-X of spark plug electrode 10. The change in concentration of the noble metal is thus particularly uniform.

Figure 4:
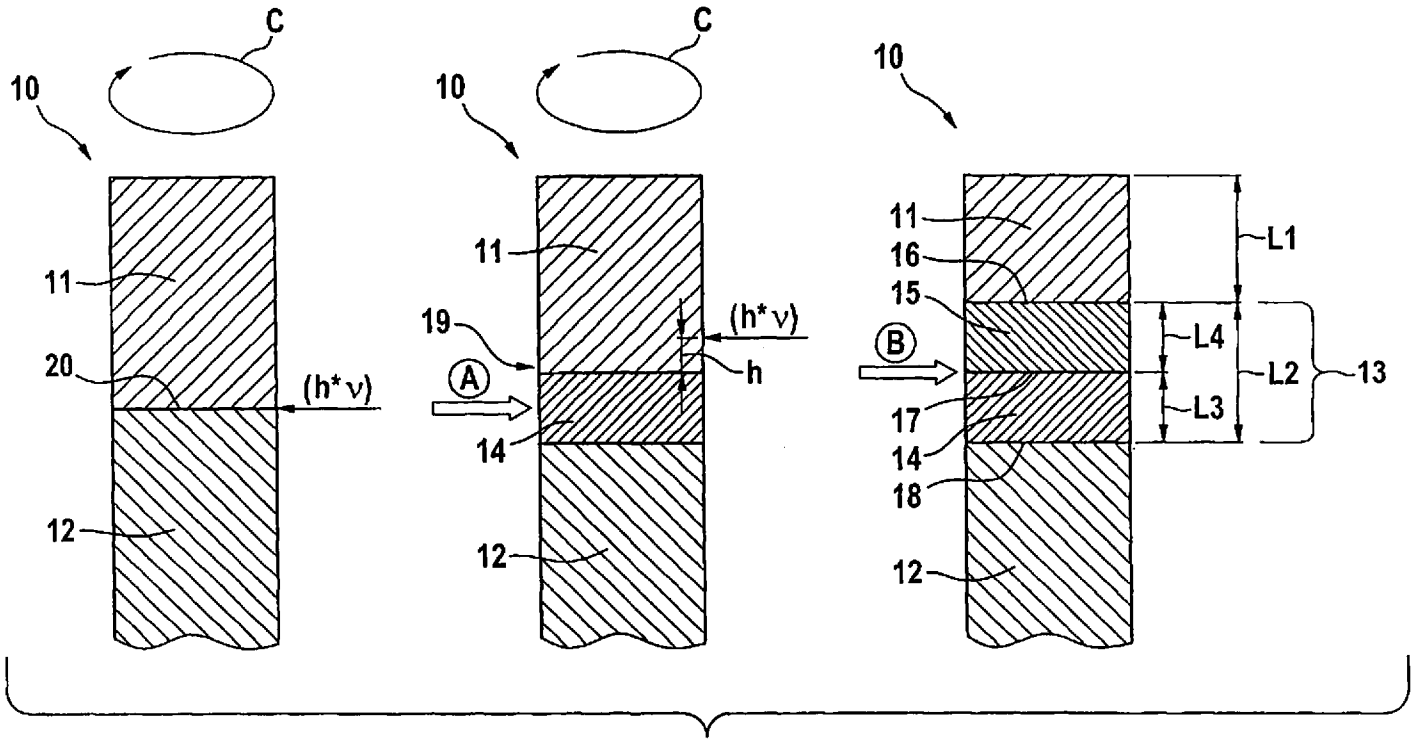
FIG. 4 shows a schematic sectional view during the production process of the spark plug electrode from FIG. 2.

FIG. 4 shows a schematic sectional view during the production process of spark plug electrode 10 from FIG. 2. First, a noble metal pin 11 is placed on a base body 12. A laser beam, symbolized by (h*v), is directed onto a joining surface 20 between noble metal pin 11 and base body 12. A first welding operation A is carried out in this way. The laser beam melts the materials of noble metal pin 11 and base body 12 mutually abutting in connection surface 20 so that a first welding seam 14 is developed, which contains the elements of noble metal pin 1 and base body 12 in a relatively balanced mixture concentration.

During welding operation A, spark plug electrode 10 is rotated in the direction of arrow C, so that connection surface 20 is uniformly exposed to the laser beam on all sides. The laser beam is preferably generated by a CW laser and completely penetrates the materials to be welded. After first welding seam 14 has been produced with the aid of first welding operation A, the laser beam is newly oriented, i.e., advantageously toward a region 19 between first welding seam 14 and noble metal pin 11. However, the laser beam may also be directed to a region between first welding seam 14 and base body 12, which, however, leads to a somewhat more strongly changing noble metal concentration from noble metal pin 11 toward first welding seam 14 and is therefore not preferred as much.

In second welding operation B, the laser beam is preferably directed to a region 19 which lies at a distance from connection surface 20 of first welding seam 14 and noble metal pin 11 by a height h in the direction of noble metal pin 11. Height h in particular amounts to 5 μm to 50 μm, and in particular to 10 μm to 30 μm.

First welding seam 14 and noble metal pin 11 are melted by second welding operation B. A second welding seam 15 having a further mixture concentration of the elements is developed; because of the fusing of further noble metal from noble metal pin 11, the noble metal concentration in second welding seam 15 is greater than the noble metal concentration in first welding seam 14.

Length L of noble metal pin 11 and the length of base body 12 have decreased in favor of connection zone 13. Due to the decreasing noble metal concentration starting from noble metal pin 11 across connection zone 13 to base body 12, which shows no abrupt decrease in the noble metal concentration, a characteristic of the coefficient of thermal expansion along these regions that is likewise without abrupt changes is obtained. Tensions at boundary surfaces 16, 17, 18 of mutually abutting regions are reduced, which increases the mechanical stability of spark plug electrode 10.

What is claimed is:

1. A spark plug electrode, comprising:

a base body; and a pin of noble metal situated on the base body, wherein the base body and the pin of noble metal are connected to each other by a connection zone:

that includes at least one first welding seam and one second welding seam; and in which a concentration of the noble metal changes, in a longitudinal direction of the spark plug electrode, by maximally 40 mass-% per interval of 100 μm length of the connection zone.

2. The spark plug electrode as recited in claim 1, wherein (i) the first welding seam is disposed between the pin and the base body, the second welding seam is situated between the first welding seam and the pin, and the concentration of the noble metal in the first welding seam is less than the noble metal in the second welding seam, or (ii) the second welding seam is situated between the first welding seam and the base body and the concentration of the noble metal in the first welding seam is greater than the concentration of the noble metal in the second welding seam.

3. The spark plug electrode as recited in claim 1, wherein a length of the noble metal pin in the longitudinal direction of the spark plug electrode amounts to maximally 900 μm.

4. The spark plug electrode as recited in claim 1, wherein a length of the noble metal pin in the longitudinal direction of the spark plug electrode amounts to maximally 80 μm to 200 μm.

5. The spark plug electrode as recited in claim 1, wherein a length of the first welding seam and a length of the second welding seam are the same in size in the longitudinal direction of the spark plug electrode.

6. The spark plug electrode as recited in claim 1, wherein the noble metal is selected from Ir, Rh, Pt, Pd, Re, alloys of these elements and alloys of these elements with nickel.

7. The spark plug electrode as recited in claim 1, wherein the base body is developed from a nickel-containing alloy, and a nickel in the alloy amounts of at least 50 mass-% in relation to the total weight of the alloy.

8. The spark plug electrode as recited in claim 1, wherein in the longitudinal direction of the spark plug electrode, the concentration of the noble metal in the connection zone changes by maximally 25 mass-% per interval of 100 μm length of the connection zone.

9. A method for producing a spark plug electrode having a base body and a noble metal pin, the method comprising:

carrying out a first welding operation for connecting the noble metal pin and the base body of the spark plug electrode while developing a first welding seam that, in an axial direction parallel to a central longitudinal axis of the spark plug, is bounded by the noble metal pin at a first side of the first welding seam and by the base body at a second side of the welding seam; and carrying out a second welding operation in a region between the first welding seam and the noble metal pin while developing a second welding seam, wherein:

a noble metal concentration in the first welding seam is less than a noble metal concentration in the second welding seam with a first side interfacing with the noble metal pin and a second side interfacing with the first side of the first welding seam;

the second welding operation is performed by directing a laser beam at a location of the noble metal pin that is, in the axial direction, at a distance from the first side of the first welding seam;

prior to the performance of the second welding operation, a portion of the noble metal pin extends in the axial direction between the first side of the welding seam and the location at which the laser beam is directed in the second welding operation; and the first welding seam and the second welding seam form a connection zone of the noble metal noble metal pin and the base body.

10. The method as recited in claim 9, wherein a noble metal component in the first welding seam and in the second welding seam amounts to at least 40 mass-% in relation to the total weight of the first welding seam and the second welding seam.

11. The method as recited in claim 10, wherein the noble metal component in the first welding seam and in the second welding seam amounts to at least 50 mass-% in relation to the total weight of the first welding seam and the second welding seam.

12. The method as recited in claim 9, wherein in a longitudinal direction of the spark plug electrode, the noble metal concentration in the connection zone changes by maximally 40 mass-% per interval of 100 μm length of the connection zone.

13. The method as recited in claim 9, wherein in a longitudinal direction of the spark plug electrode, the noble metal concentration in the connection zone changes by maximally 25 mass-% per interval of 100 μm length of the connection zone.

14. The method as recited in claim 9, wherein a length of the connection zone in a longitudinal direction of the spark plug electrode amounts to 50 μm to 700 μm.

15. The method as recited in claim 9, wherein a length of the connection zone in a longitudinal direction of the spark plug electrode amounts to 100 μm to 600 μm.

16. The method as recited in claim 9, wherein the welding is carried out by laser welding with the aid of a CW laser.

17. The method as recited in claim 9, wherein the distance is 5 μm to 50 μm.

18. The method as recited in claim 17, wherein the distance is 10 μm to 30 μm.

19. The method as recited in claim 9, wherein the laser beam completely penetrates the materials to be welded during the first welding operation and the second welding operation.

20. The method as recited in claim 9, wherein the spark plug electrode is rotated during the first and second welding operations.

* * * * *